US005207600A

United States Patent [19]

Van Dulmen

[11] Patent Number: 5,207,600

[45] Date of Patent: May 4, 1993

[54] LAMPHOLDER FOR A HIGH-PRESSURE GAS DISCHARGE LAMP

[75] Inventor: Hendrikus A. M. Van Dulmen, Eindhoven, Netherlands

[73] Assignee: U.S. Philips Corporation, New York, N.Y.

[21] Appl. No.: 755,928

[22] Filed: Sep. 6, 1991

[30] Foreign Application Priority Data

Sep. 28, 1990 [NL] Netherlands ..... 9002123

[51] Int. Cl.[5] ..... H01R 13/10

[52] U.S. Cl. ..... 439/682; 439/356; 313/51

[58] Field of Search ..... 439/356, 456, 605, 611, 439/612, 617, 619, 682, 683, 686, 691, 699; 313/51, 318

[56] References Cited

U.S. PATENT DOCUMENTS

| | | | |
|---|---|---|---|
| 2,563,775 | 8/1951 | Camp | 439/683 |
| 3,397,379 | 8/1968 | Puig | 439/456 X |
| 4,253,717 | 3/1981 | Stewart | 439/456 X |
| 4,569,568 | 2/1986 | Agabekov | 439/682 X |
| 4,741,712 | 5/1988 | Greiler | 439/683 |
| 4,823,049 | 4/1989 | Sanders et al. . | |

FOREIGN PATENT DOCUMENTS 2100404A 12/1982 United Kingdom .

*Primary Examiner*—Larry I. Schwartz
*Assistant Examiner*—Khiem Nguyen
*Attorney, Agent, or Firm*—Paul R. Miller

[57] ABSTRACT

A lamp holder has a housing which comprises a base part and a cover part. The cover part, which has contact holes to receive terminals of a high pressure gas discharge lamp to provide access to contact members, is integral with a partition wall which extends inside and outside of the housing between the contact holes. The partition wall which divides the housing into chambers extends into a recess in the base part. The cover part and the base part form curved channels through which electric cables are led to respective contact members. As a result of these measures, the risk of breakdown is avoided, yet the lamp holder structure can be compact.

8 Claims, 2 Drawing Sheets

LAMPHOLDER FOR A HIGH-PRESSURE GAS DISCHARGE LAMP

The invention relates to a lampholder for a high-pressure gas discharge lamp comprising a housing of electrically insulator material in which a first and a second contact member are enclosed, which housing comprises a base part having a mounting surface, which is to make contact with a carrier, and a cover part which is provided with contact openings for receiving respective contact pins of the lamp and for affording access to respective contact members, the base part having cable openings for guiding electric cables to respective contact members, which housing comprises a partition wall which extends inside and outside the housing between the contact openings and divides the space in the housing into chambers for the respective contact members.

BACKGROUND OF THE INVENTION

Such a lampholder for a high-pressure gas discharge lamp is commercially available. A similar lampholder is known from British Application No. GB 2,100,404 A.

Since high-pressure gas discharge lamps can have a high colour temperature, a high-colour rendering index and a high brightness, these lamps are highly suitable for applications where a compact light source is required in order to form a beam in conjunction with a reflector, for example, for studio or projection purposes.

A disadvantage of high-pressure gas discharge lamps is that a very high voltage, for example of the order of a few tens of kilovolts, is necessary for re-igniting the lamp in the hot state. Under such circumstances, severe damage to the lamp or the lamp cap can arise as a result of breakdown if live parts are insufficiently insulated from one another. To prevent breakdown between the current conductors, or from a current conductor to the luminaire mass, under such circumstances, it is necessary for creepage paths along surfaces of the lampholder to be sufficiently long. This requirement implies that the dimensions of such a lampholder are greater than those of a similar lampholder destined for a lower voltage. This is a disadvantage for applications, for example, for portable illumination equipment, where it is desirable to keep the dimensions, and thus the weight, as limited as possible. To overcome this disadvantage, concessions are often made with regard to the electrical properties. The disadvantage of this is that the lampholder is only allowed to be used if additional mounting instructions and insulation instructions are complied with. It is recommended for the known lampholder to be mounted on an insulated carrier.

SUMMARY OF THE INVENTION

The invention has for its object to provide a lampholder of the kind described in the opening paragraph which, among other characteristics, prevents breakdown at high ignition voltages, is safe to touch for the user, but is nevertheless compact.

According to the invention, this object is achieved in that the cover part and the base part form a curved channel for each of the cables to a respective contact member, the cover part is integral with the partition wall, while the base part has a recess which is opposite to the cover part and into which the partition wall projects.

The risk of breakdown between the contact members and a carrier is reduced in that the electric cables are passed to the exterior through curved channels. Since the channels each have a curve, long creepage paths can be accompanied by a compact space in which these creepage paths are present. Since the partition wall is integral with the cover part, there can be fewer chinks in the cover part than in a lampholder in which the partition wall is connected to the base part. The risk of breakdown through the cover part to the exterior is thus even further limited.

It is advantageous if the partition wall has extension pieces which are transverse to this wall inside the housing. These extension pieces make the creepage paths longer than could be realised in the available space with a straight partition wall without extension pieces, and further reduce the risk of breakdown inside the lampholder. Since the extension pieces are positioned transverse to the partition wall, the length of the wall may be limited and the lampholder may be of small dimensions, and therefore compact.

It is favourable if the partition wall forms a raised edge around each of the contact openings outside the housing. Not only is the risk of breakdown between live parts, for example contact pins of a lamp, via the outer surface of the cover part strongly reduced by this, but it also prevents the possibility of a user coming into contact with a voltage when inadvertently touching the lampholder.

It is attractive if the base part has an upright rim which surrounds the cover part at least substantially. The upright rim lengthens the creepage path from the current supply conductors to the exterior of the lamp holder. This measure thus also contributes to a greater safety for the user and a greater protection from the risk of breakdown to the surroundings.

In a favourable embodiment, the cable openings in the base part allow the cables to issue from the housing in a direction which lies between parallel to and transverse to the mounting surface. Such a design has a greater number of mounting possibilities. The cables may, for example, leave the lampholder sideways, but alternatively they may be passed directly through openings in a surface on which the lampholder is mounted.

It is advantageous if three distributed elevations are provided on the mounting surface of the base part. The lampholder can assume a stable position thanks to the elevations, also when the carrier on which the lampholder is mounted is not perfectly flat.

BRIEF DESCRIPTION OF THE DRAWING FIGURES

This and other aspects will be explained in more detail with reference to the drawings.

DESCRIPTION OF THE INVENTION

Figure 1:
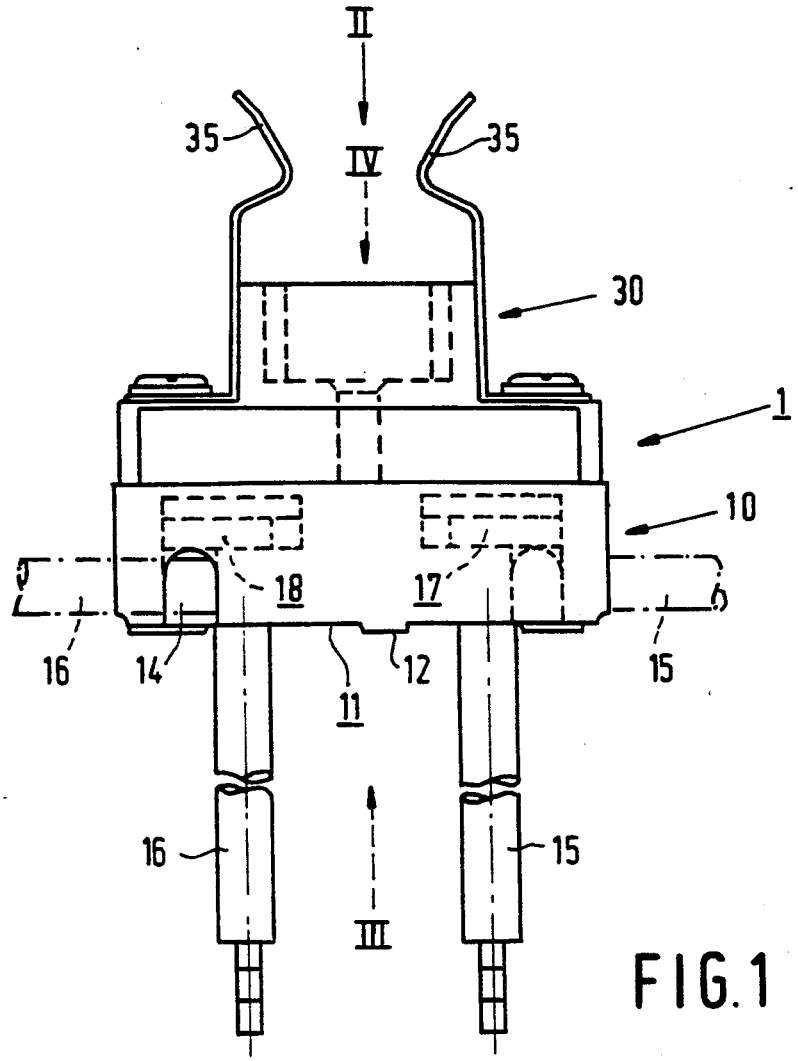
FIG. 1 shows the lampholder in side elevation.

In FIG. 1, the lampholder comprises a housing 1 of electrically insulator material, for example ceramic material, such as steatite or glass/mica, in which a first and a second contact member (2, 3 in FIG. 3, respectively) are enclosed.

Figure 2:
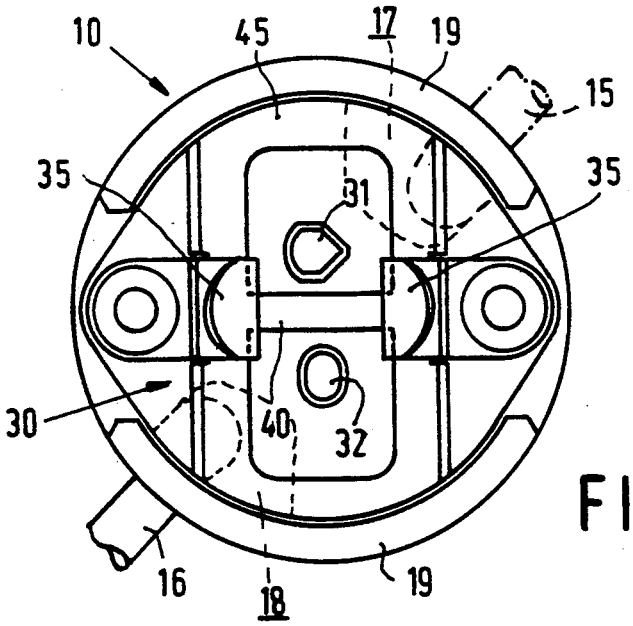
FIG. 2 shows the lampholder of FIG. 1 viewed from II.

The housing further comprises a base part 10 with a mounting surface 11 which is to make contact with a carrier upon mounting, and a cover part 30 which comprises contact openings (31, 32 in FIG. 2). The contact openings 31, 32 are suitable for receiving respective contact pins of a high-pressure gas discharge lamp and giving them access to respective contact members 2, 3. Cable openings (13, 14 in FIG. 4) are provided in the base part for guiding electric cables 15, 16 to respective contact members 2, 3.

The housing 1 also comprises a partition wall 40 (FIG. 2), which extends inside and outside the housing 1 between the cable openings, dividing the space in the housing 1 into chambers 41, 42 (FIG. 3) for the respective contact members 2, 3.

Recesses (20*a*, 20*b*; 21*a*, 21*b* in FIG. 4) and (33, 34 in FIG. 3) are provided in the cover part 30 and the base part 10, respectively, so that the cover part 30 and the base part 10 form a curved channel 17, 18 to a respective contact member 2, 3 for each of the cables 15, 16.

The cover part 30 is integral with the partition wall 40. Opposite the cover part 30, the base part 10 has a recess 22 into which the partition wall 40 projects (see FIG. 4).

Cable openings 13, 14 are provided in the base part 10, which enable the cables 15, 16 to issue from the housing 1 in a direction which lies between parallel to the mounting surface (shown in broken lines) and perpendicular thereto.

In the embodiment drawn, the lampholder has two retention springs 35 by which a high-pressure gas discharge lamp can be securely fastened in the lampholder. The base part 10 and the cover part 30 have mounting openings 24 which are in one another's extension, so that the base part 10, the cover part 30 and the retention springs 35 can be assembled into a unit or can be fastened on a carrier by means of a pair of fasteners, for example hollow rivets.

FIG. 2 shows that the partition wall 40 forms a raised edge 45 around each of the contact openings 31, 32. Live parts are thus screened both relative to one another and relative to the surroundings.

The base part 10 has an upright rim 19 which surrounds the cover part 30 for the major part. In order to realise a compact shape of the lampholder, the upright rim 19 has a local interruption, so that space is available for a lateral enlargement of the cover part 30 comprising mounting openings 24. The locations of the interruptions are so chosen that the distance from the mounting openings 24 to the contact members 2, 3 is as great as possible.

Figure 3:
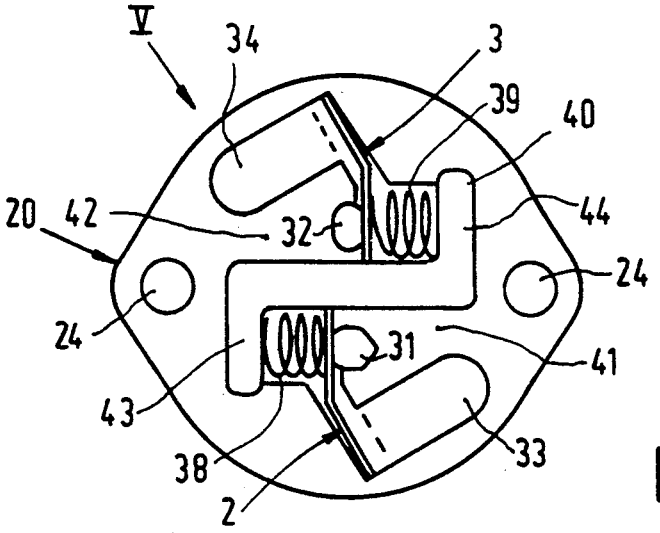
FIG. 3 shows the cover part of the lampholder of FIG. 1 viewed from III.

In the embodiment drawn in FIG. 3, the partition wall 40 has extension pieces 43, 44 at the side of the cover part 30 opposite the base part 10 which are transverse to the wall. Not only is a compact construction of the partition wall 40 possible thanks to these transversely oriented extension pieces 43, 44 and are creepage paths from the contact members 2, 3 to the mounting holes 24 made longer, but the surroundings of the lampholder are also screened off from the contact members 2, 3 at the area where the upright rim 19 has interruptions. In the chambers 41, 42 formed by the partition wall there are respective contact members 2, 3. In the embodiment drawn, the contact members 2, 3 lie under spring pressure in front of the contact openings 31, 32. Thus a good electrical connection can be achieved when contact pins of a high-pressure gas discharge lamp are inserted through the openings 31, 32. The contact members 2, 3 are pressed home by springs 38, 39 in order to improve the reliability of the connection.

Figure 4:
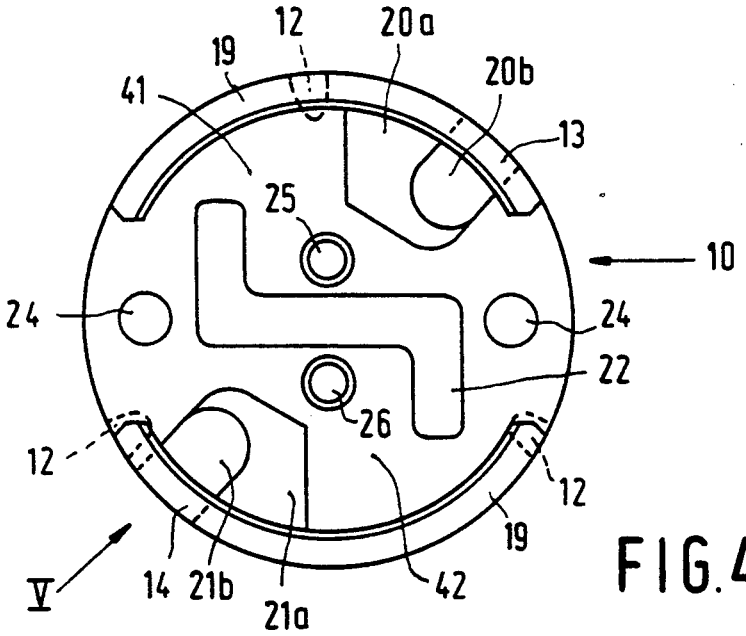
FIG. 4 shows the base part of the lampholder of FIG. 1 viewed from IV.

In FIG. 4, the base part 10 has a recess 22 into which the partition wall 40 can project opposite the cover part 30. Furthermore, recesses 20*a*, 20*b*; 21*a*, 21*b* are provided which form curved channels 17, 18 in the cover part 30 (FIG. 3) in conjunction with recesses 33, 34, which channels allow the electric cables 15, 16 to have access to the contact members 2, 3. The channels 17, 18 may have, for example, portions 20*a*, 21*a* which run parallel to the mounting surface and portions 20*b*, 21*b* which have a direction perpendicular to the mounting surface 11 and which issue in the cable openings 13, 14.

In the extension of the contact openings (31, 32 in FIG. 2), the base part 10 has two depressions 25, 26 in which the end portions of contact pins of a high-pressure gas discharge lamp can be accommodated.

In the FIG. 4, elevations 12, by which the mounting surface 11 can rest on a carrier, are indicated in broken lines. The lampholder can have a stable position as a result of the elevations, even when the carrier is not flat.

Figure 5:
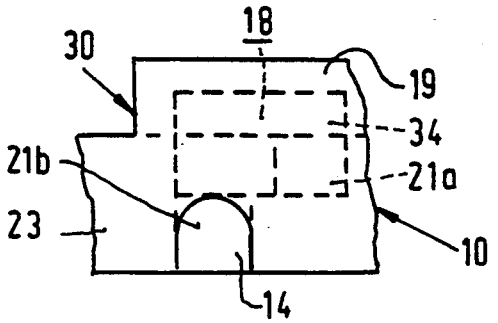
FIG. 5 shows part of the lampholder viewed from V in FIGS. 3 and 4.

In FIG. 5 it is indicated in broken lines how a curved channel 18 is formed by means of recesses (34 in FIG. 3 and 21*a*, 21*b* in FIG. 4, respectively) in the cover part 30 and the base part 10, which channel allows an electric cable to have access to a contact member (3 in FIG. 3).

I claim:

1. A lampholder for a high-pressure gas discharge lamp comprising a housing of electrically insulator material in which a first contact member and a second contact member are enclosed, which housing comprises a base part having a mounting surface, and a cover part which is provided with contact openings for affording access to respective contact members, the base part having cable openings for guiding electric cables to respective contact members, and which housing comprises a partition wall which extends inside and outside the housing between the contact openings and divides a space in the housing into chambers for the respective contact members, characterized in that the cover part and the base part form a curved channel for each of the cables to a respective contact member, and the cover part is integral with the partition wall, while the base part has a recess which is opposite to the cover part and into which the partition wall projects, and characterized in that the partition wall forms a raised edge around each of the contact openings outside the housing.

2. A lampholder as claimed in claim 1, characterized in that the partition wall has extension pieces inside the housing which are transverse to said wall.

3. A lampholder as claimed in claim 1, characterized in that the base part has an upright rim which surrounds the cover part at least substantially.

4. A lampholder as claimed in claim 1, characterized in that the cable openings in the base part allow the cables to issue from the housing in a direction which lies between parallel to and transverse to the mounting surface.

5. A lampholder as claimed in claim 1, characterized in that three distributed elevations are provided on the mounting surface of the base part.

6. A lampholder as claimed in claim 2, characterized in that the base part has an upright rim which surrounds the cover part at least substantially.

7. A lampholder as claimed in claim 2, characterized in that three distributed elevations are provided on the mounting surface of the base part.

8. A lampholder as claimed in claim 2, characterized in that the cable openings in the base part allow the cables to issue from the housing in a direction which lies between parallel to and transverse to the mounting surface.

* * * * *